United States Patent [19]

Fukada

[11] Patent Number: 4,846,606

[45] Date of Patent: Jul. 11, 1989

[54] EXCAVATED EARTH AND SAND TRANSPORTING APPARATUS FOR USE IN A SHIELD MACHINE

[75] Inventor: Masao Fukada, Hirakata, Japan

[73] Assignee: Kabushiki Kaisha Komatsu Seisakusho, Tokyo, Japan

[21] Appl. No.: 138,931

[22] Filed: Dec. 29, 1987

[30] Foreign Application Priority Data

Jan. 11, 1985 [JP] Japan ..... 60-244120

[51] Int. Cl.[4] ..... E21D 9/12

[52] U.S. Cl. ..... 405/144; 405/138; 405/141

[58] Field of Search ..... 405/138, 141, 144, 145, 405/146, 147, 150, 142, 139; 299/33, 31

[56] References Cited

U.S. PATENT DOCUMENTS 1,999,419 4/1935 Mercier ..... 405/144 X
3,350,889 11/1967 Sturm ..... 405/144 X
3,410,098 11/1968 Winberg ..... 405/144
3,561,223 2/1971 Tabor ..... 405/144
4,286,935 9/1981 Okuno et al. ..... 425/72 R
4,456,304 6/1984 Yoshikawa et al. ..... 405/144 X

*Primary Examiner*—Dennis L. Taylor
*Attorney, Agent, or Firm*—Frost & Jacobs

[57] ABSTRACT

An excavated earth and sand transporting apparatus for use in a shield machine for carrying the earth and sand excavated by a cutter head mounted on the most front part of a shield proper through a screw conveyor followed by a transporting pipe to rearward of the shield proper. The excavated earth and sand transporting apparatus has an excavation discharging device mounted between the screw conveyor and the transporting pipe to discharge the earth and sand or the excavation conveyed by the screw conveyor into the transporting pipe while keeping a predetermined earth pressure inside the cutter head chamber so that the spouting of spring water can be prevented without having to use a bentonite slurry and/or a clay slurry and that the excavated earth and sand or excavation can be discharged efficiently and effectively.

2 Claims, 5 Drawing Sheets

EXCAVATED EARTH AND SAND TRANSPORTING APPARATUS FOR USE IN A SHIELD MACHINE

BACKGROUND OF THE INVENTION

1. Field of the Invention

This invention relates to a shield machine, and more particularly to an excavated earth and sand transporting apparatus for use in an earth pressure type shield machine by which much consisting of a mixture of excavated earth and sand, gravel, water etc. is carried to rearward of the shield machine and removed therefrom.

2. Description of the Prior Art

Conventional earth pressure type excavated earth and sand transporting apparatuses for use in shield machines are constructed such that one end of a screw conveyor is disposed inside a cutter head chamber mounted on the most front part of the shield proper, and the muck consisting of a mixture of excavated earth and sand, gravel and water etc. is carried by the screw conveyor to rearward of the shield proper. The arrangement is made such that, during the transportation of the muck, the amount of earth to be removed is restricted by gate means mounted on the rear end of the screw conveyor, and the resultant consolidation provides formation of a plug zone, which can resist the earth pressure and water pressure exerted on the face of a tunnel, inside the screw conveyor so that the excavated earth and sand may be conveyed to the outside in the form of a muck while the face is kept in a stable condition.

In such conventional apparatuses, however, it has been very difficult to regulate the degree of opening of the gate of the gate of the gate means in response to changes in the nature of soil in the natural ground to be excavated, the earth pressure, water pressure and the amount of water, and in consequence accidents such as spouting of the earth and sand and water have occurred frequently.

To eliminate this disadvantage, there have been employed a method of injecting a bentonite slurry and/or a clay slurry into the cutter head chamber or onto the front surface of the tunnel being excavated to form an impermeable layer inside the cutter head chamber or inside the screw conveyor thereby preventing spouting of spring water or a method of installing a rotary feeder behind the gate means of the screw conveyor so as to remove the excavated muck divided into sections or the like.

However, the above-mentioned method of injecting the bentonite slurry and/or clay slurry not only renders the cost expensive, but also gives naturally a limit in the capacity of the pump to supply slip agent or drilling mud of such a high concentration enough to prevent spouting of spring water, in particular, in dead water containing gravel layers. And also, because of the high concentration of the slip agent and/or drilling mud which are liable to stick, such a phenomenon as blocking of the cutter head and the screw conveyor occurred frequently. Further, in case the concentration of such fluids was reduced, it became naturally impossible to form a plug zone capable of preventing spouting of spring water, and therefore such a disadvantage as spouting-out of the earth and sand and ground water took place.

Whilst, in dead water containing gravel layers, if and when a rotary feeder is installed behind the gate means of the screw conveyor, the size of the rotary feeder suitable for the sizes of the gravels to be removed by the screw conveyor becomes big, and as a result, such a disadvantage as difficulty in bringing-in and assembly operation of segments and scattering of the muck removed from the rotary feeder thus rendering it impossible to load the muck on the belt conveyor which is the subsequent transport means which results in contamination of the tunnel pit being excavated took place.

SUMMARY OF THE INVENTION

The present invention has been devised in view of the above-mentioned circumstances, and has for its object to provide an excavated earth and sand transporting apparatus for use in a shield machine which can overcome the disadvantages encountered in the prior art apparatuses and which can prevent spouting-out of spring water without having to use a bentonite slurry and/or a clay slurry and can discharge the excavated earth and sand efficiently and effectively.

To achieve the above-mentioned object, according to the present invention, there is provided an excavated earth and sand transporting apparatus for use in a shield machine for carrying the earth and sand excavated by a cutter head mounted on the most front part of a shield proper through a screw conveyor followed by a transporting pipe to rearward of the shield proper, characterized in that it comprises an excavation discharging device mounted between said screw conveyor and said transporting pipe to discharge the earth and sand conveyed by the screw conveyor into the transport pipe while keeping a predetermined earth pressure inside the cutter head chamber.

The above and many other advantages, features and additional objects of the present invention will become apparent to those skilled in the art upon making reference to the following detailed description and accompanying drawings in which preferred structural embodiments incorporating the principles of the present invention are shown by way of illustrative example.

DETAILED DESCRIPTION OF THE PREFERRED EMBODIMENT

Figure 1:
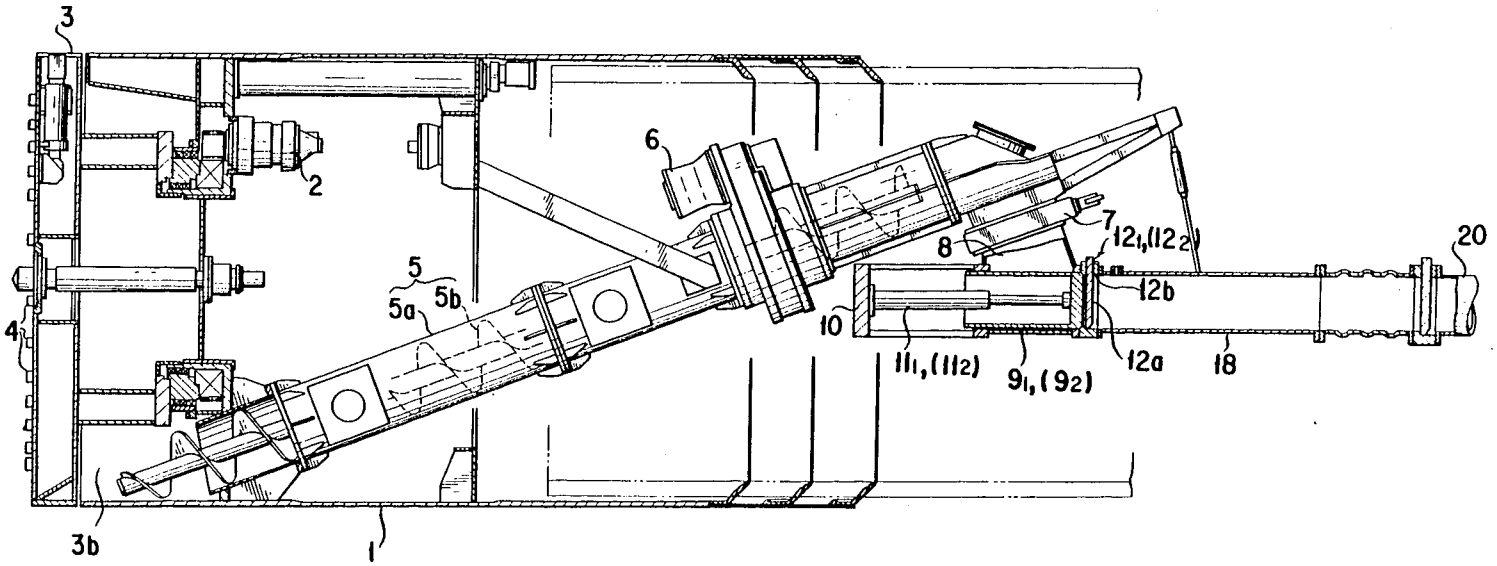
FIG. 1 is a schematic longitudinal sectional view of a shield proper incorporating one embodiment of excavated earth and sand transporting apparatus according to the present invention.
Figure 2:
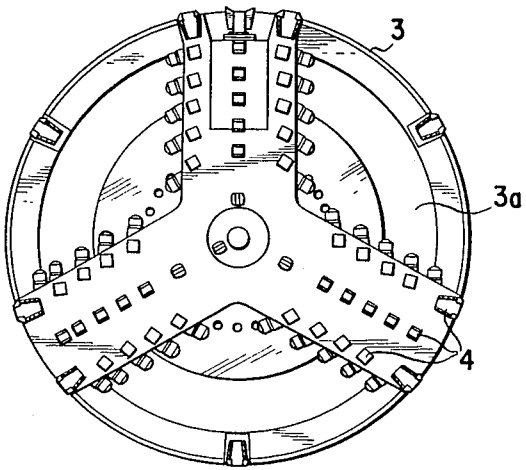
FIG. 2 is a schematic plan view of the shield proper.

The present invention will now be described in detail below by way of example only with reference to the accompanying drawings.

Referring to FIGS. 1 to 6, reference numeral 1 denotes a shield proper adapted to excavate underground and which has a cutter head 3 mounted on the front portion thereof and adapted to be rotated by a driving power source 2. The above-mentioned cutter head 3 has a plurality of radially extending cutters 4 mounted on the front surface thereof. The arrangement is made such that the muck excavated by the cutters 4 with the rotation of the cutter head 3 is carried through an excavated earth and sand inlet port 3*a* into a hermetically sealed cutter head chamber 3*b*.

Further, the excavated earth and sand or excavation taken into the cutter head chamber 3*b* is conveyed by a screw conveyor 5 through the inside of the shield proper 1 to rearward thereof. The above-mentioned screw conveyor 5 is of a construction that it comprises a cylindrical casing 5*a* having a screw 5*b* rotatably mounted therein and which is inclined such that its level on the side of the cutter head chamber 3*b* is low, whilst its level on the rear side of the shield proper 1 is high. The leading end of the casing 5*a* opens into the cutter head chamber 3*b*, and the leading end of the screw 5*b* projecting out from the opening of the casing 5*a* is arranged to take therein the excavated earth and sand or excavation carried into the cutter head chamber 3*b*. Further, the casing 5*a* has a driving power source 6 mounted on the outer periphery of the rear end thereof. The above-mentioned screw 5*b* is arranged to be rotatively driven by the driving power source 6 through gears, not shown.

Figure 6:
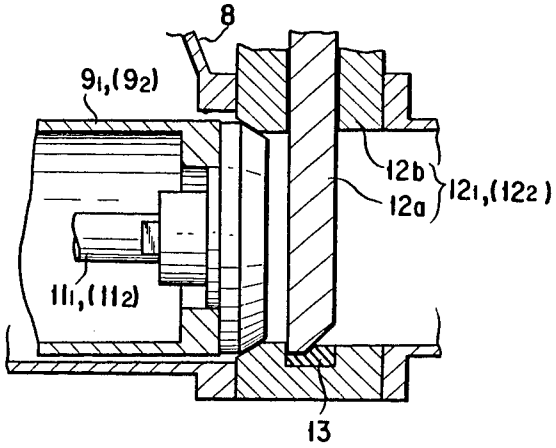
FIG. 6 is an enlarged view of the part encircled with a circle in FIG. 3.
Figure 5:
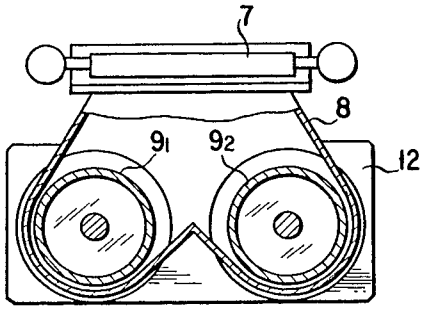
FIG. 5 is a schematic, sectional view taken along line V—V in FIG. 3.

Further, the above-mentioned screw conveyor 5 has a main gate 7 mounted on the rear end thereof and which is adapted to be closed in case of emergency, during stoppage for long time and at the time of maintenance and inspection and to be opened during the ordinary excavation. Under the main gate 7, there is installed a hopper 8. Inside the above-mentioned hopper 8, a pair of cylindrical pistons $9_1$ and $9_2$ are juxtaposed in parallel relationship with each other. These pistons $9_1$ and $9_2$ are arranged to be individually reciprocated by hydraulic cylinders $11_1$ and $11_2$, respectively, which are mounted between a bracket 10 projecting from the above-mentioned hopper 8 and the pistons $11_1$, $11_2$, respectively. The side surface of the hopper 8 opposite to the above-mentioned bracket 10 is connected through gates $12_1$ and $12_2$ for the pistons $9_1$ and $9_2$, respectively, with one end of an excavation discharge pipe 18. Each of the above-mentioned gates $12_1$ and $12_2$ has a gate plate 12*a* adapted to be vertically moved up and down by a driving power source, not shown, so as to open and shut along guides 12*b* mounted on both sides of the gate plate 12*a*. As shown in FIG. 6, installed below each of the gate plates 12*a* is cushion rubber 13 adapted to absorb the shock caused by the gate plate 12*a* at the time of its downward movement for closure and ensure to maintain seal between them.

Figure 3:
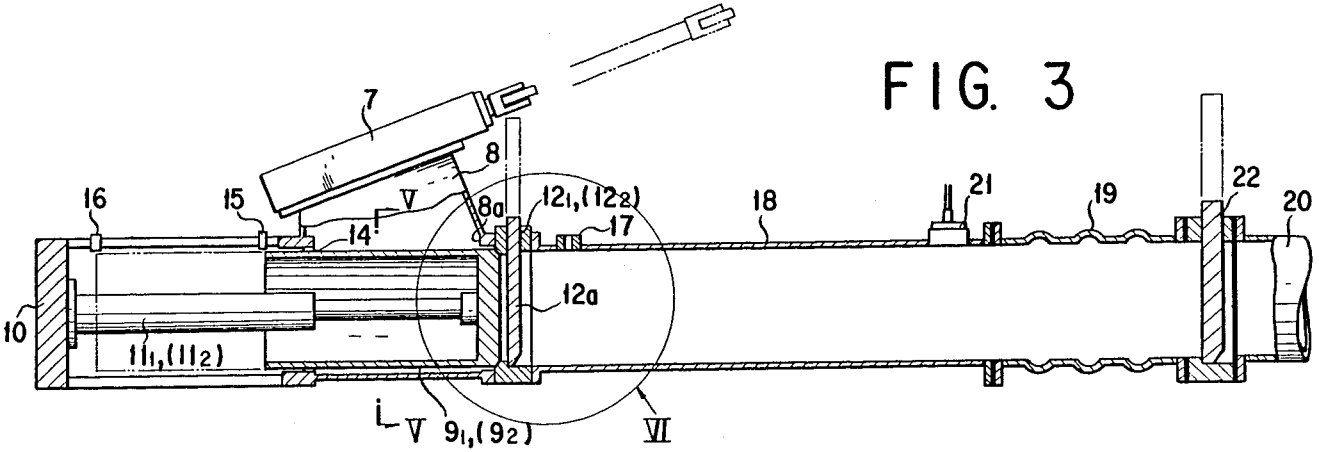
FIGS. 3 and 4 are schematic, longitudinal sectional view and schematic plan view, respectively, of the earth and sand discharging device.
Figure 4:
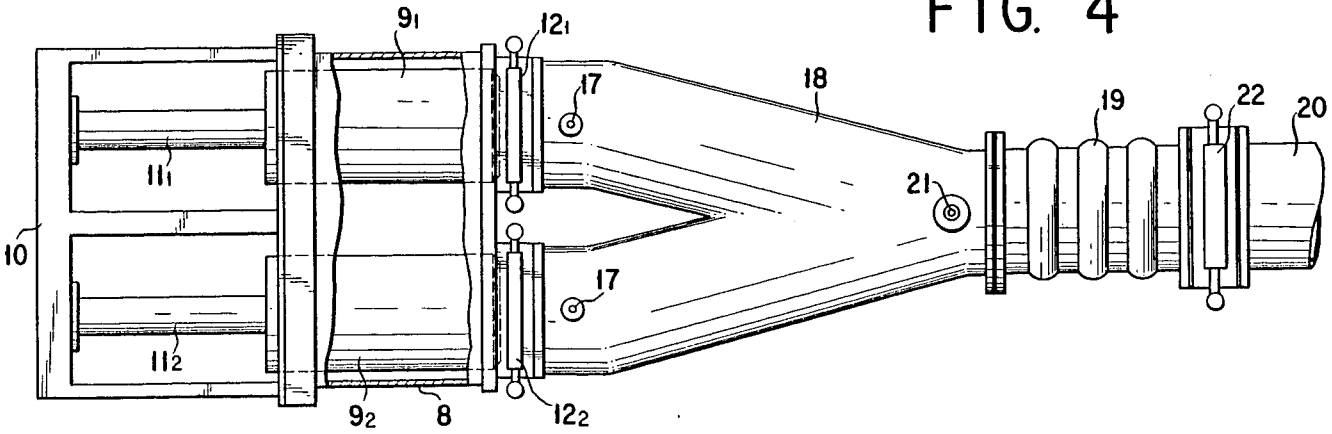

Further, with reference to FIG. 3, reference numeral 14 denotes a sealing member mounted between the hopper 8 and the pistons $9_1$ and $9_2$ to keep the hopper 8 in liquid-tight condition, 15, 16 limit switches for detecting the positions of the pistons $9_1$ and $9_2$, and 17 a lubricant injection port through which a lubricant is injected into the excavation discharge pipes 18.

Whilst, the other ends of the above-mentioned excavation discharge pipes 18 are joined and connected through an elastic pipe 19 capable of expansion and contraction with a transporting pipe 20, and also an earth pressure gauge 21 is attached to the joined portion of the excavation discharge pipes 18 and a gate 22 is mounted between the elastic pipe 19 and the transporting pipe 20. This gate 22 and the gates $12_1$ and $12_2$ are arranged to be controlled to open and shut off as will be mentioned later.

The excavation carrying-out operation will now be described below.

The earth and sand excavated by the cutter head 3 with the propulsion of the shield proper 1 is taken in the cutter head chamber 3*b*, and then carried out by the screw conveyor 5, and at the same time, the pistons $9_1$, $9_2$, the gates $12_1$, $12_2$ and the gate 22 commence their operations as follows.

Prior to commencement of operations, the gates $12_1$, $12_2$ and 22 are in completely shut condition, and the pistons $P_1$, $P_2$ are at their fully extended positions closing the dropping port 8*a* of the hopper 8 completely.

Firstly, the piston $9_1$ is retracted or pulled backward by the hydraulic cylinder $11_1$ from this condition thus allowing the dropping port 8*a* of the hopper 8 to open so that the muck conveyed by the screw conveyor 5 may drop to the bottom of the hopper 8. When the piston $9_1$ has reached its fully retracted position, the limit switch 16 detects it and opens the gate $12_1$. At the same time when the gate $12_1$ is opened fully, the hydraulic cylinder $11_1$ is actuated to advance the piston $9_1$ so as to push the much within the hopper 8 into the excavation discharge pipes 18. When a predetermined earth pressure, for example, 0.2 to 7 kg/cm$^2$ (which is preset depending on the nature of the soil) is detected by the earth pressure gauge 21 attached to the terminal end of the excavation discharge pipes 18, the gate 22 is opened fully so as to discharge the muck in the excavation discharge pipes 18 into the transporting pipe 20.

Whilst, when it is detected by the limit switch 15 that the piston $9_1$ has reached its fully extended position, the gate $12_1$ is shut fully, and at the same time the gate 22 is also shut fully. Simultaneously with the detection of the complete closure of the gate 22, the piston $9_2$ is pulled rearward by the hydraulic cylinder $11_2$ so as to open the dropping port 8*a* of the hopper 8 so that the muck may drop to the bottom of the hopper 8. Thereafter, when it is detected by the limit switch 16 that the piston $9_2$ has been retracted fully, the gate $12_2$ is opened. With the complete closure of the gate $12_2$, the piston $9_2$ commences to advance to push the muck inside the hopper 8 into the excavation discharge pipes 18. When the predetermined earth pressure is detected by the earth pressure gauge 21, the gate 22 is opened so that the excavation carried into the excavation discharge pipes 18 can be discharged into the transporting pipe 20.

When it is detected by the limit switch 15 that the piston $9_2$ has reached its fully extended position, the gate $12_2$ is shut fully, and at the same time, the gate 22 is also shut fully. Simultaneously with the detection of the complete closure of the gate 22, the piston $9_1$ is pulled backward. After that, by repeating the above-mentioned operations, the much carried into the hopper 18 is discharged into the transporting pipe 20.

Figure 7:
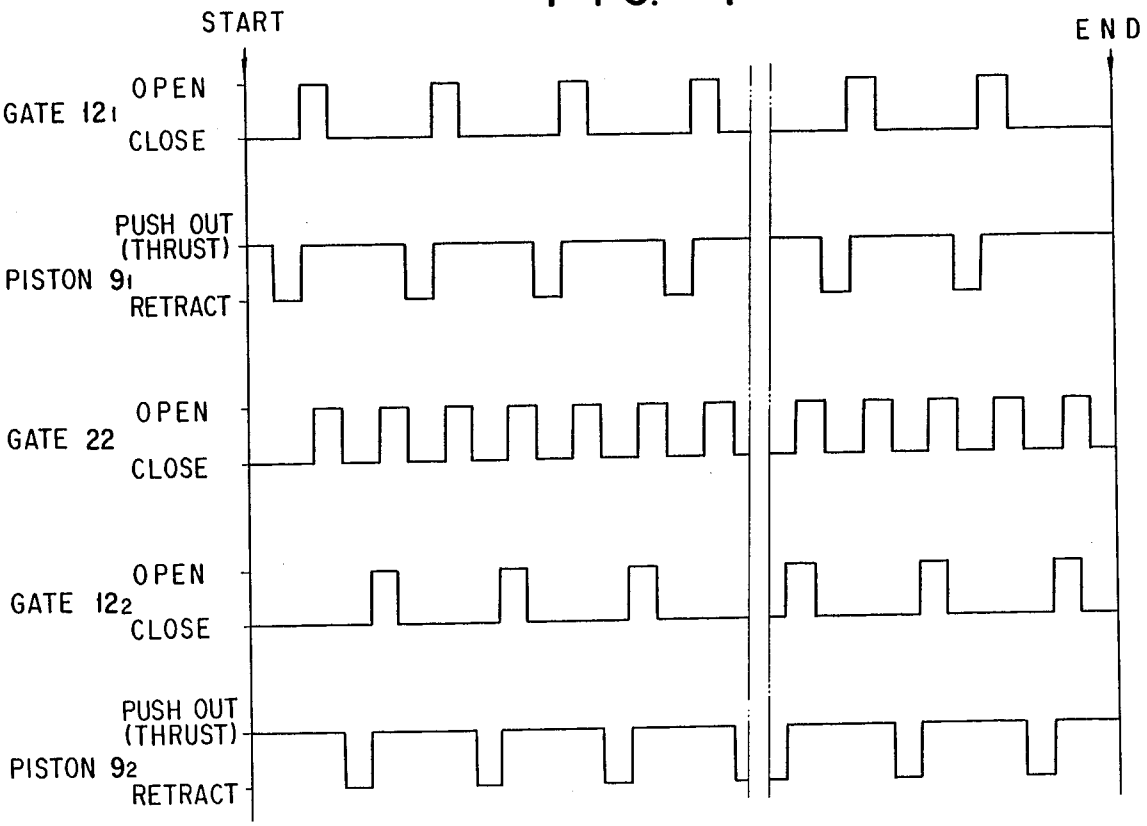
FIG. 7 is a timing chart showing the timing of actuating the excavated earth and sand transporting apparatus according to the present invention.

Further, the timing of actuation of the above-mentioned pistons $9_1$, $9_2$, gates $12_1$, $12_2$ and gate 22 is indicated in the timing chart shown in FIG. 7.

Further, in case spring water gushes out when the muck with a low permeability, which depends on the nature of the soil in the natural ground, is being carried out by the screw conveyor 5, there are cases where the resultant water pressure is stopped by the screw conveyor 5. At that time, the excavation can be discharged more efficiently by actuating, in turn, the piston $9_1$, the gate $12_1$, the piston $9_2$ and the gate $12_2$ while the gate 22 is kept fully open.

Further, in cases where the muck is liable to deposit in the excavation discharge pipes 18 and the transporting pipe 20 and the muck consists mainly of sand or the like which is liable to settle or precipitate, more smooth excavation discharge can be achieved by injecting a lubricant from the lubricant injection port 17 to thereby reduce the frictional resistance in the pipes 18 and 20.

Further, it is possible to discharge the excavation by actuating only one of the pistons $9_1$ and $9_2$ depending on work condition.

It is to be understood that the foregoing description is merely illustrative of preferred embodiments of the invention, and that the scope of the invention is not to be limited thereto, but is to be determined by the scope of the appended claims.

What is claimed is:

1. An excavated earth and sand transporting apparatus for use in a shield machine for carrying earth and sand excavated by a cutter head mounted on the frontmost part of a shield proper from a chamber connected to said cutter head through a screw conveyor followed by a transport pipe to the rear of said shield proper, including an excavation discharging device mounted between said screw conveyor and said transport pipe to discharge the earth and sand conveyed by the screw conveyor into said transport pipe while keeping a predetermined earth pressure inside said cutter head chamber, wherein said excavated earth and sand transporting apparatus comprises (a) a main gate mounted on the rear end of said screw conveyor and adapted to be opened during the ordinary advancement for excavation; (b) a hopper mounted below the main gate; (c) a pair of left and right cylindrical pistons supported by a bracket projecting from the hopper and slidably mounted inside the hopper; (d) a pair of left and right hydraulic cylinders connected between said bracket and said pair of cylindrical pistons so as to reciprocate said pistons; (e) an Y-shaped excavation discharging pipe connected at one end thereof with said hopper; (f) a pair of left and right gate means mounted between the excavation discharging pipe and said hopper; and (g) an elastic pipe capable of expansion and contraction for connecting the other end of said excavation discharging pipe with said transport pipe.

2. The excavated earth and sand transporting apparatus as set forth in claim 1, characterized in that an earth pressure gauge is attached to the portion of said excavation discharging pipe near the other end thereof, and a gate means is mounted between said elastic pipe and said transporting pipe.

* * * * *